US005117653A

United States Patent [19]

Kil

[11] Patent Number: 5,117,653

[45] Date of Patent: Jun. 2, 1992

[54] AIR EXHAUST AND WATER DRAIN APPARATUS FOR AIR CONDITIONER

[75] Inventor: Yong H. Kil, Suweon, Rep. of Korea

[73] Assignee: Samsung Electronics Co., Ltd., Suweon, Rep. of Korea

[21] Appl. No.: 624,101

[22] Filed: Dec. 10, 1990

[30] Foreign Application Priority Data

Dec. 9, 1989 [KR] Rep. of Korea ..... 18673/89[U]

[51] Int. Cl.[5] ..... F25D 21/14

[52] U.S. Cl. ..... 62/291; 62/409

[58] Field of Search ..... 62/285, 291, 409, 410

[56] References Cited

U.S. PATENT DOCUMENTS

| | | | |
|---|---|---|---|
| 2,773,676 | 12/1956 | Boyle et al. | 62/285 X |
| 2,909,043 | 10/1959 | Baker et al. | 62/285 |
| 4,385,505 | 5/1983 | Umezu et al. | 62/285 |
| 4,553,405 | 11/1985 | Napolitano et al. | 62/410 X |
| 4,907,420 | 3/1990 | Mahanay et al. | 62/285 X |
| 4,953,364 | 9/1990 | Lee | 62/285 |

*Primary Examiner*—William E. Tapolcai
*Attorney, Agent, or Firm*—Cushman, Darby & Cushman

[57] ABSTRACT

A separable air conditioner includes a blow fan for intaking and discharging room air, a heat-exchanger for cooling intaking air and an air exhaust and water drain apparatus mounted below but adjacent to the heat-exchanger to force the fan to blow air across its lower portion. The air exhaust and water drain apparatus includes a pan assembly extending overall width of the heat-exchanger for collecting condensing water from the heat-exchanger. The pan assembly is provided with a flat portion projecting inward adjacent to the one upper to position the heat-exchanger thereon and a recess formed with a surface inclined from the flat portion and a rear wall; an air exhaust and water drain assembly is provided with an air exhaust duct mounted adjacent to one side end of the pan assembly, a damper for opening and closing an opening portion formed at one side of the air exhaust duct, an air exhaust passage portion arranged adjacent to the air exhaust duct, the air exhaust passage portion having a water drain portion for introducing condensing water from the pan assembly thereinto, and an air exhaust and water drain member extending outward from the air exhaust passage portion.

6 Claims, 4 Drawing Sheets

AIR EXHAUST AND WATER DRAIN APPARATUS FOR AIR CONDITIONER

BACKGROUND OF THE INVENTION

The present invention relates to providing an air exhaust and water drain apparatus for an air conditioner, and particularly to providing an air exhaust and water drain apparatus adapted to an indoor unit of a separable air conditioner, for discharging drain water collected in a pan assembly during operation of the air conditioner, as well as exhausting room air to ventilate a room.

A conventional air conditioner, especially an indoor unit of a separable air conditioner usually mounted on one wall in a room of a house, is provided with a separate drain hose for processing condensing water, but it was impossible to mount a ventilating unit in such an air conditioner and so it could not exchange indoor foul air with outdoor fresh air.

A typical indoor separable air conditioner unit is disclosed in Japan Utility Model Laid Open Publication No. Sho 61-63636. The unit comprises a fan for intaking outdoor air, another fan for exhausting room air externally to outdoors, a heat-exchanger for cooling air intaken by the first-mentioned fan, a duct mounted to direct air towards outdoors, for ventilating a room, through at least one fan operation including intaking and exhaust, and a drain duct arranged on one side of the duct to drain water from a pan which collects condensing water below the heat-exchanger. Therefore, it is known that the unit must be provided with at least two ducts, for example an air exhaust duct and a water drain duct, respectively, for discharging room foul air and condensing water to the exterior. Furthermore, the unit usually has disadvantages due to the freezing of water collected in the pan, which is mounted adjacent to a heat-exchanger. Freezing causes the pan to be ruptured into freezing and condensing water can flush over the pan.

Also, a conventional air conditioner of a one unit-type, such as a window-type air conditioner, has an air exhaust duct and a water drain duct. A typical example is described in Japan Utility Model Laid-Open No. Sho 60-180938, wherein a ventilating fan exchanges room air by its intaking and/or exhausting operations between indoors and outdoors, a heat-exchanger cools intaken air, a pan collects condensing water from the heat-exchanger and a water drain passage discharges condensing water collected in the pan casing. However, the unit does not have means for blocking air exhaust and is maintained in an air-exhausting exhausting condition even when exhausting of air is not required, thereby reducing the heat-exchanging efficiency. It is also noted that the unit must have at least two ducts, respectively, for the air intaking/exhausting passage and the water drain passage, and the distance between the pan casing and the ventilating fan is relatively too great to prevent the freezing of condensing water in the pan casing mounted adjacent to the heat-exchanger.

SUMMARY OF THE INVENTION

Accordingly, the main object of the invention is to provide an air exhaust and water drain apparatus for using one air exhaust and water drain portion in common to discharge condensing water produced during the operation of an air conditioner as well as to ventilate a room.

Another object of the invention is to provide an air exhaust and water drain apparatus for preventing the freezing of condensing water in a pan assembly, the pan assembly being mounted directly below a heat exchanger to contact with air from a blow fan through its overall area.

Another object of the invention is to provide an air exhaust and water drain apparatus including a damper opening/closing control means for operating a damper for exhausting room air only when the ventilating of room air is required, independent of the operating or non-operating of an air conditioner.

The invention comprises a blow fan for intaking/discharging room air, a heat-exchanging means for cooling intaking air and an air exhaust and water drain apparatus mounted below and adjacent to the heat-exchanging means to force the fan to blow air across a lower portion of the air exhaust and water drain apparatus.

The air exhaust and water drain apparatus according to the principles of the invention comprises a pan assembly extending throughout the overall width of the heat-exchanging means, for collecting condensing water from the heat-exchanging means. The pan assembly is provided with a flat portion projecting inwardly adjacent to the one upper of its front wall to position the heat-exchanging means thereon, and a recess is formed with a surface inclined from the flat portion and a rear wall. An air exhaust and water drain assembly is provided with an air exhaust duct mounted adjacent to one side end of the pan assembly. A damper opening/closing an opening portion is formed at one side of the air exhaust duct. An air exhaust passage portion is arranged adjacent to the air exhaust duct. The air exhaust passage portion has a water drain portion for introducing condensing water into the pan assembly, and an air exhaust and water drain member extends outward from the air exhaust passage portion.

Thus, according to the invention, the pan assembly collects condensing water with a flat portion supporting a heat-exchanging means and discharges collected water through a water drain portion and an air exhaust and water drain member to the exterior.

The air exhaust duct acts to pass air intaken by a blow fan therethrough and then to exhaust it through an exhaust passage portion externally, when a damper mounted at the opening portion of its one side is opened to ventilate the room.

Also, air passing through a heat-exchanging means is caused to flow in contact with the lower portion of a pan assembly, so that circulating air may prevent the freezing of condensing water collected in a pan assembly, leading to smooth draining of the water.

The invention allows an air exhaust and water drain apparatus to perform both the air exhaust function and the water draining function, simultaneously.

BRIEF DESCRIPTION OF THE INVENTION

The invention is explained in detail below with reference to the accompanying drawings, wherein.

DETAILED DESCRIPTION OF A PREFERRED EMBODIMENT OF THE INVENTION

Figure 1:
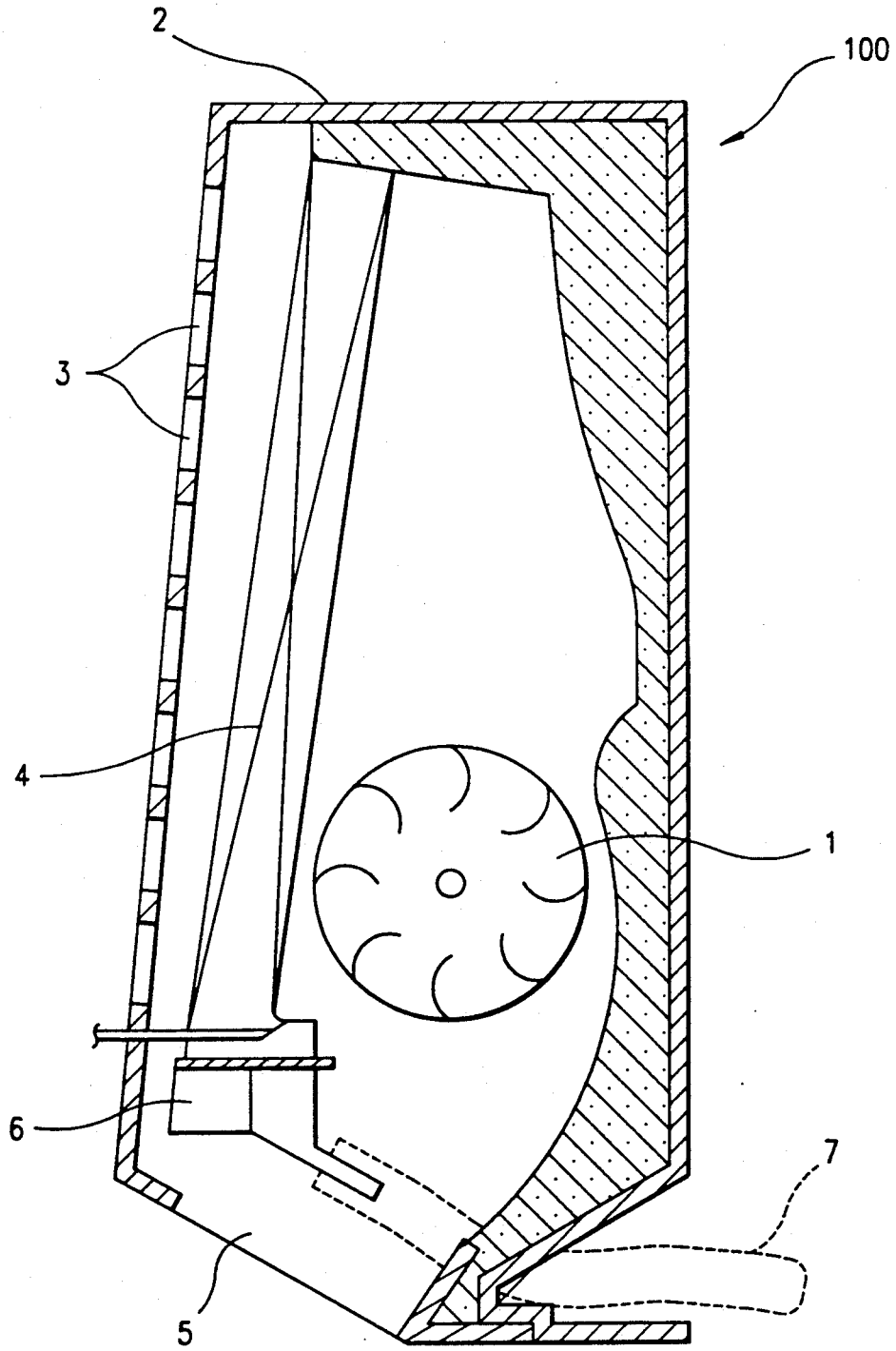
FIG. 1 PRIOR ART
FIG. 1 is a cross-sectional view showing schematically the structure of an indoor unit as a part of a conventional separable air conditioner.

A prior art generally separable air conditioner is shown in FIG. 1. In that device, warm room air introduced by blow fan 1 through the intaking portion 3 into body 2 is cooled passing through heat-exchanger 4 and then is discharged downward below the lower portion of body 2 through discharging portion 5. Condensing water from the heat-exchanger is collected in water drain unit 6, for example a pan mounted below heat-exchanger 4 and then is discharged through discharging tube member 7, externally.

Figure 2:
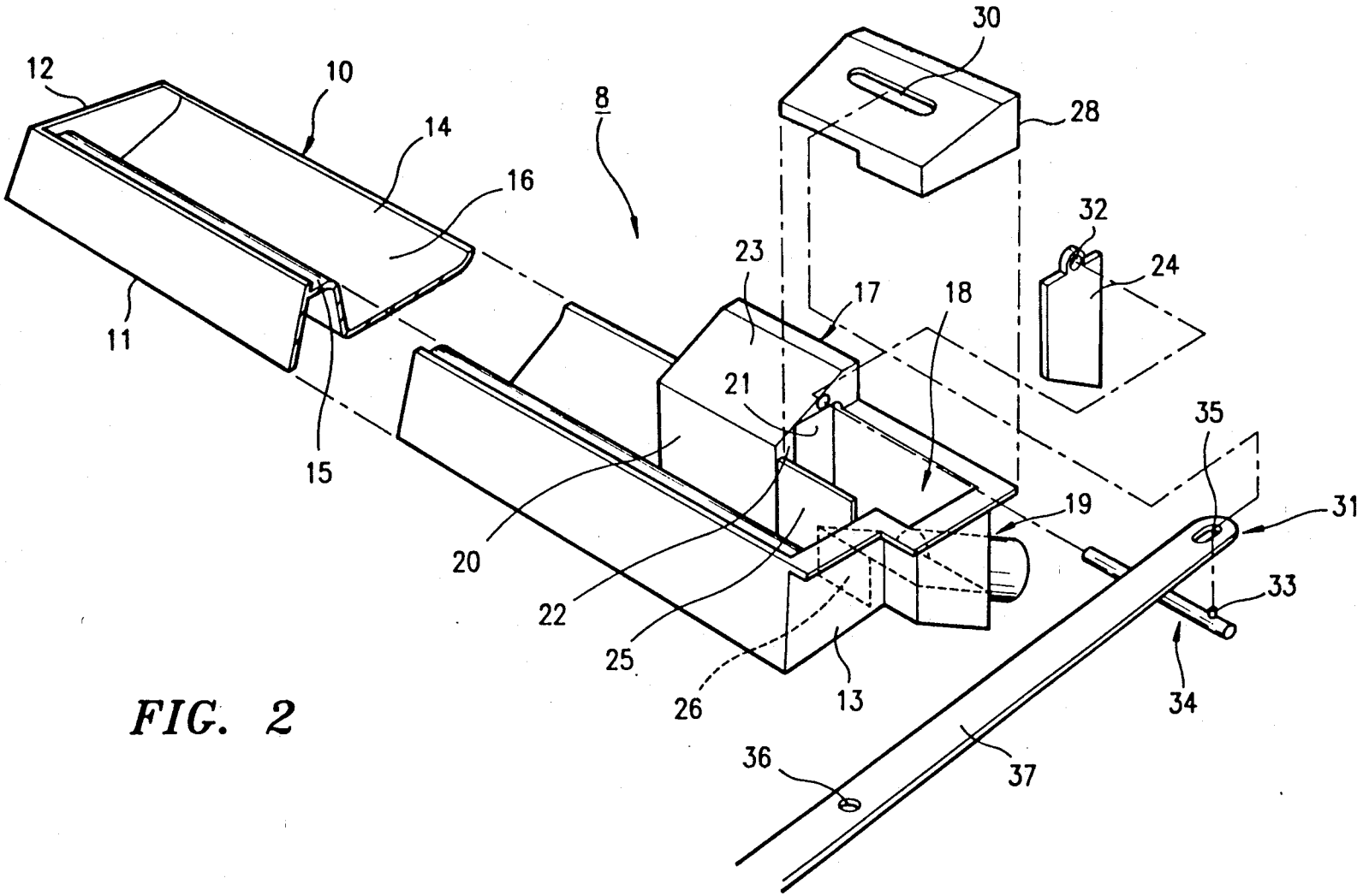
FIG. 2 is an exploded perspective view illustrating an air exhaust and water drain apparatus provided with a pan assembly according to the principles of the present invention.
Figure 3:
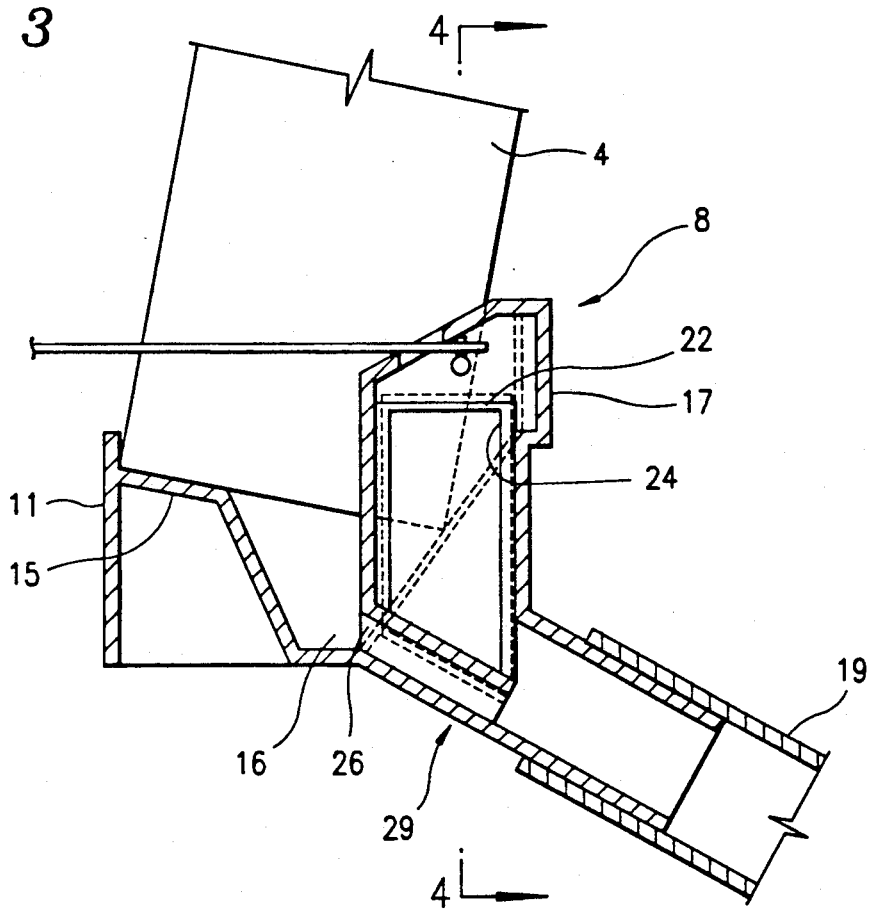
FIG. 3 is a cross-sectional view showing the right side of the apparatus of the invention.

On the other hand, referring to FIG. 2, an air exhaust and water drain apparatus 8 according to the invention is positioned below and adjacent to the heat-exchanger 4 as shown in FIG. 3, so that its lower portion may be directly contacted with room air to be exhausted. Air exhaust and water apparatus 8 includes pan assembly 10 extending slightly longer than overall width of heat-exchanger 4. Pan assembly 10 is provided with front wall 11, left and right walls 12, 13, outwardly depending rear wall 14 and flat portion 15 projecting inwardly a predetermined distance from the top portion of front wall 11. These walls are flush with each other. Recess 16 in the form of a groove is formed so as to be inclined downwardly from the rear peripheral end of flat portion 15, being extended horizontally at a bottom surface a predetermined distance and being coupled integrally to depending rear wall 14. Thus, heat-exchanger 4 is coupled with flat portion 15 in the manner to be positioned thereupon.

In pan assembly 10, there is installed an air exhaust and water drain assembly which includes air exhaust duct 17 mounted adjacent to the one side of heat-exchanger 4, air exhaust passage portion 18 for introducing air form air exhaust duct and discharging tube member 19 for exhausting room air or draining condensing water.

Air exhaust duct 17 contains rear wall 20 extending upwardly from a bottom surface of recess 16, a left wall (not shown), right wall 22 having opening 21 formed to exhaust air, and top portion 23 slanting upward over the rear wall 14. The front surface of rear wall 14 is open. In opening 21 there is mounted damper 24 so as to open and close opening 21.

Air exhaust passage portion 18 has another rear wall 25 extending from rear wall 20, in one end of which water drain portion 26 is formed adjacent to said wall 13 of pan assembly 10. Also, air exhaust passage portion 18 is provided with cover portion 28 and air exhaust portion 29, in which cover portion 28 is slanted upwardly toward rear wall 14 to cover a cavity formed by side wall 13 and rear wall 14 of pan assembly 10 and right wall 22 of air exhaust duct 17, and air exhaust portion 29 is associated with water drain portion 26 to discharge room air and/or condensing water, to the end of which air exhaust and water drain member 19 is fixed. Cover portion 28 has elongated hole 30 formed at its middle portion. Elongated hole 30 cooperates with damper opening/closing control apparatus 31 opening/closing damper 24.

Damper opening/closing control apparatus 31 includes moving bar 34 for moving damper 24 leftward and rightward, and damper opening/closing control rod 37 cooperating with moving bar 34. Moving bar 34 has one end fitted into fixing hole 32 on the upper portion of damper 24, adjacent to other end of which projector 33 is integrally formed. Damper opening/closing control rod 37 is extended sufficient to allow user to control it from the exterior of the unit. Also, it has pivot point 36 at a predetermined position to control moving bar 34 and hole 35, into which projector 33 is inserted.

Figure 4:
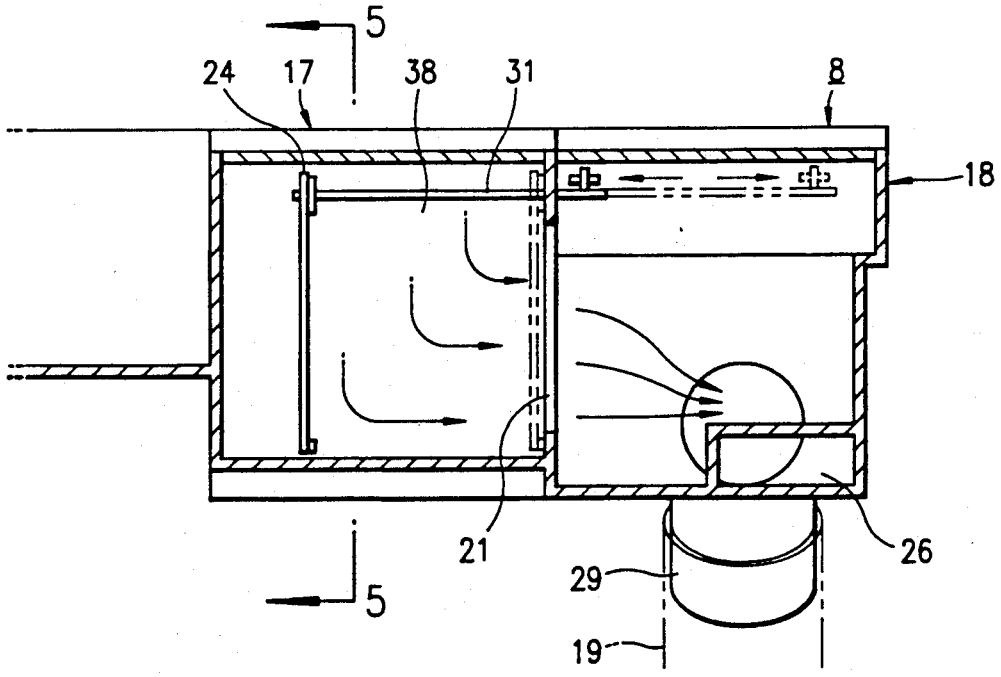
FIG. 4 is a cross-sectional view taken along line 4—4 of FIG. 3, illustrating an air exhaust duct and passage portion according to the invention; and, FIG. 5 is a cross-sectional view taken along line 5—5 of FIG. 4.
Figure 5:
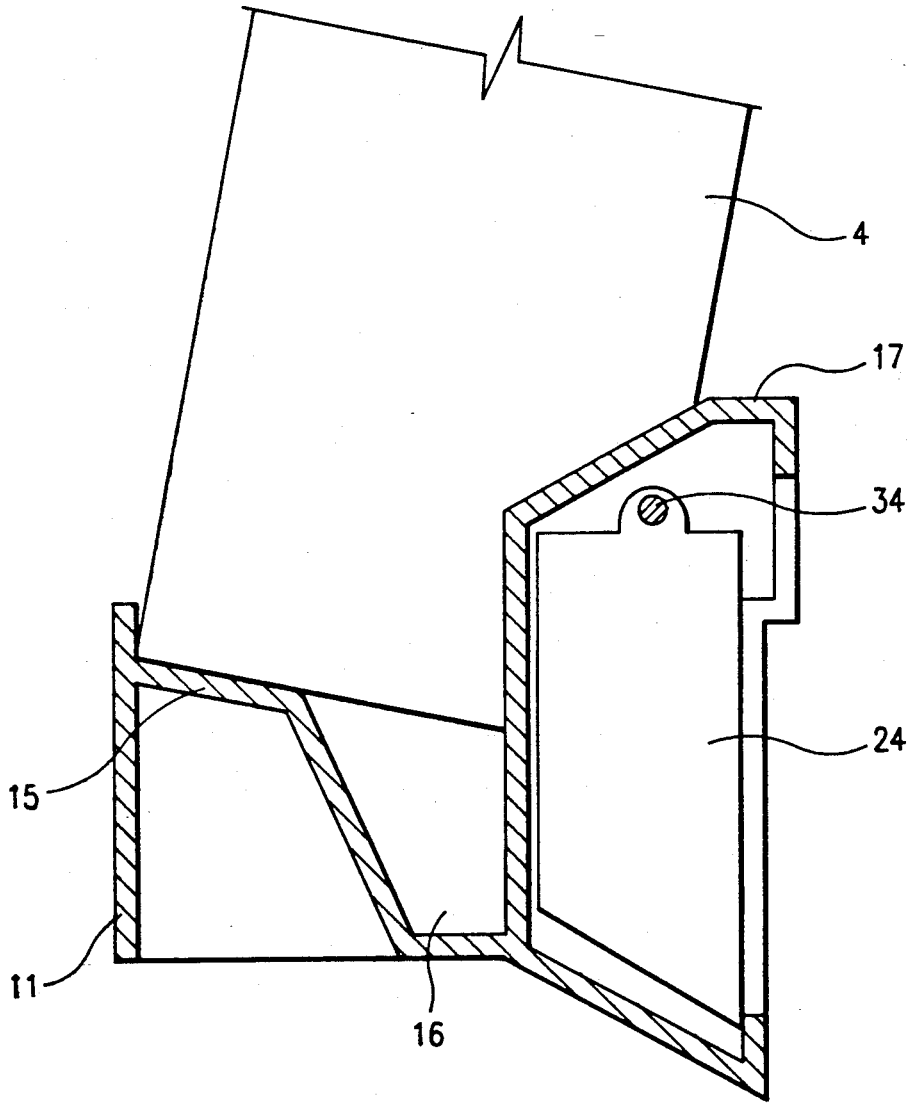

Therefore, as shown in FIG. 4 and FIG. 5, moving bar 34 is mounted in air exhaust passage portion 18 with its end being coupled to the upper of damper 24, in which damper 24 is retained in cavity 38. Damper opening/closing control rod 37 is inserted into elongated hole 30 to be coupled at its end to projector 33 of moving bar 34. Damper opening/closing control rod 37 is rotated centering its pivot point 36 by the operation from the exterior of the unit to move moving bar 34 leftward and rightward. At that time, if moving bar 34 moves damper 24 leftward, opening 21 is opened to discharge room air introduced from air exhaust duct 28 through air exhaust passage portion 18 and air exhaust portion 29, externally. On the contrary, if damper 24 is moved rightward, opening 21 is closed.

Also, condensing water collected by pan assembly 10 is discharged to externally from recess 16 through water drain portion 26 and air exhaust portion 29 at air exhaust and water drain member 19.

As described above, the invention discharges condensing water collected in recess 16 and/or air to be exhausted. when it is necessary to ventilate the room in which the device is located, the air exhaust portion 29 is used in common, so that the exhaust of room air as well as the water drain may be performed simultaneously.

Thus, the invention increases the discharging efficiency of condensing water and allows room air to be ventilated. if necessary. For example, room air is able to be exhausted even though the blow fan is not operated. Also, a pan assembly is directly below a heat-exchanger to contact condensing water with air to be exhausted by the blow fan, thereby preventing freezing of the collected water.

What is claimed is:

1. An air conditioner, including:

a blow fan for intaking and discharging room air;

a heat-exchanging means for cooling intaken air; and an air exhaust and water drain apparatus mounted below adjacent to the heat-exchanging means said air exhaust and water drain apparatus comprising:

a pan assembly extending throughout all of the width of said heat-exchanging mean and being disposed for collecting condensing water from the heat-exchanging means, said pan assembly being provided with a front wall, two opposite side ends, and a flat portion projecting rearwards adjacent an upper end thereof, said heat-exchanging means being supportingly positioned on said flat portion, and a recess formed in said pan assembly, with a surface inclined from said flat portion, and said pan assembly having a rear wall;

an air exhaust duct mounted adjacent to one side end of said pan assembly;

a damper for opening and closing an opening portion formed in one side of said air exhaust;

an air exhaust passage portion arranged adjacent to said air exhaust duct;

said air exhaust passage portion having a water drain portion for introducing condensing water collected in the pan assembly thereinto; and an air exhaust and water drain member extending outward from the said air exhaust passage portion.

2. An air exhaust and water drain apparatus as claimed in claim 1, wherein:

said air exhaust and water drain assembly is mounted on one side of said heat-exchanging means adjacent to said pan assembly, said damper being mounted in said air exhaust duct, said air exhaust passage portion including a cover portion slanted upward toward a rear wall to cover the top portion thereof, said cover portion having an elongated hole to receive one end of a damper opening and closing control apparatus.

3. An air exhaust and water drain apparatus as claimed in claim 2, wherein:

said damper opening and closing control apparatus includes a moving bar for moving the damper leftward and rightward and a damper opening and closing control rod having one end fixed to a projector for the moving bar and a pivot point formed at a middle portion of the moving bar to control side to side pivotal movement of the moving bar for moving the damper leftward and rightward.

4. An air exhaust and water drain apparatus as claimed in claim 1, wherein:

the air exhaust passage portion has a rear wall extended from a rear wall of said air exhaust duct adjacent to said recess, said rear wall of said air exhaust passage portion including a water drain portion formed to discharge condensing water.

5. A room air conditioner, comprising:

a body which houses a heat exchanger effectively interposed between an air intake into said and an air discharge from the body, and a blow fan for drawing air from a room, into the body through the air intake and past the heat exchanger, and out of said body through said air discharge; said heat exchanger having a given width;

a combined air exhaust and water drain assembly for draining from said body for disposal externally of said room water which has condensed on and dripped from said heat exchanger, and foul air from said room, said combined air exhaust and water drain assembly including:

a pan assembly having front, rear, left end and right end walls and a bottom, which cooperate to form an upwardly opening trough arranged in said body under said heat exchanger for catching condensate water dripping from said heat exchanger; said bottom including an upwardly facing ledge on which a lower end of said heat exchanger supportingly rests;

said trough being wider than said given width, so that said trough extends laterally in one direction beyond said heat exchanger;

said trough, laterally beyond said heat exchanger in said one direction including a combination foul room air exhaust and condensate drain tube member which extends out of said trough, out of said body, and is arranged to extend out of said room;

an air exhaust duct means provided on said trough, laterally between said heat exchanger and an inlet opening into said drain tube member;

said air exhaust duct means including a wall means having an air inlet opening arranged to receive room air which has entered said body through said air intake, and an air outlet opening arranged to deliver room air which has entered said air exhaust duct means to said air inlet opening into said drain tube member;

a damper means movably disposed for selectively opening and closing passage through said air exhaust duct means; and a damper opening and closing device mounted to said damper means for selectively shifting said damper into and out of obstructing relation to said air exhaust duct means.

6. The room air conditioner of claim 5, wherein:

said heat exchanger is ranked behind said air intake, and both said fan and said air inlet opening of said air exhaust duct means are ranked behind said heat exchanger.

* * * * *